United States Patent [19]

Pickrell

[11] 4,281,956

[45] Aug. 4, 1981

[54] CONTAINER HANDLING MECHANISM FOR TRASH COLLECTING VEHICLES

[76] Inventor: John W. Pickrell, 4206·N. 68th St., Scottsdale, Ariz. 85251

[21] Appl. No.: 797,530

[22] Filed: May 16, 1977

Related U.S. Application Data

[63] Continuation-in-part of Ser. No. 710,621, Aug. 2, 1976, abandoned.

[51] Int. Cl.[3] ..... B65B 21/02

[52] U.S. Cl. ..... 414/409; 414/420

[58] Field of Search ..... 214/78, 80, 302, 303, 214/313, 148, 653, 701 Q; 180/137, 138, 139; 414/420

[56] References Cited

U.S. PATENT DOCUMENTS

| | | | |
|---|---|---|---|
| 793,700 | 7/1905 | Whittemore | 214/148 |
| 2,020,231 | 11/1935 | Bell | 214/302 |
| 2,362,262 | 11/1944 | French | 180/137 |
| 2,625,281 | 1/1953 | Osgood et al. | 214/148 |
| 3,040,919 | 6/1962 | Noland | 214/302 |
| 3,522,893 | 8/1970 | Yopich | 214/653 |
| 3,765,554 | 10/1973 | Morrison | 214/302 |

*Primary Examiner*—Lawrence J. Oresky
*Attorney, Agent, or Firm*—Don J. Flickinger

[57] ABSTRACT

The disclosure relates to a container handling mechanism for trash collecting vehicles which is adapted for handling small household trash containers; the mechanism adapted to pick up such trash containers from the ground at the forward portion of the vehicle and to transfer them upwardly, backwardly and into an upside-down position over a receiver on the vehicle; the mechanism comprising novel elevating and actuating means wherein a pickup arm is pivotally mounted on a pivotal support on a horizontal axis and the pivotal support is provided with means for elevating it and concurrently rotating the arm about the axis of the pivotal support. Further, the disclosure relates to the detail of such mechanism, including an incline track and a sprocket and chain, or gear and rack, mechanism for rotating said arm about said pivotal support, which is actuated by a hydraulic cylinder to elevate it upwardly and backwardly on track means.

4 Claims, 11 Drawing Figures

30
8
8
74
74
60
70
66
64
62
56
58
68
52
60
72
54
82
94
6
6
7
7
80
58
94
90
92
88
72
84
86
52
50
102
104
62
100
110
112
96
98
108
106

CONTAINER HANDLING MECHANISM FOR TRASH COLLECTING VEHICLES

This application is a continuation-in-part of my copending application, Ser. No. 710,621, Filed Aug. 2, 1976, for Container Handling Mechanism for Trash Collecting Vehicles, now abandoned.

In addition to those references of record in this application, the following patents were cited in the abandoned parent application Nos.:

793,700;
2,362,265;
3,040,919;
2,625,281;
3,522,893.

An application of the Applicant which is related to this application bears Ser. No. 857,207 and a filing date of Dec. 5, 1977. The latter application is a continuation-in-part of an application of the Applicant, Ser. No. 710,654, filed Aug. 2, 1976. The following patents are of record in the latter two application Nos.:

3,342,282;
3,912,033;
3,521,720;
3,642,765.

In another related application, Ser. No. 770,398, filed Feb. 22, 1977, the following U.S. Pat. Nos. were cited:

2,984,374;
3,380,600;
3,580,403;
2,543,295;
4,057,157;
3,325,024;
3,207,345;
3,202,305.

BACKGROUND OF THE INVENTION

Various trash collecting vehicles have been used in alley ways and along streets for the purpose of collecting trash from small household trash containers. Such prior art practice has included a vehicle with a driver and several pickup men who manually empty the containers into a receiver on the vehicle. The prior art practice has been followed primarily due to the problems of picking up and emptying such household trash containers in an alley way or other area where the containers are placed in random locations and on opposite sides of the alley way, and prior art trash collecting vehicles have not been provided with mechanism adapted for such operations or vehicles which are not properly maneuverable for handling the usual household trash collecting containers.

Most front loading trash collecting vehicles are adapted for elevating a large bin or the like, and the means by which they elevate the bin comprise pivotal mechanism, which is operable about a fixed horizontal axis on the frame or body of the vehicle, such as to limit the movement of the elevating mechanism to a fixed axis and consequently, a fixed arm length and a proportional relationship between the pickup mechanism and the vehicle, all of which has tended to provide for relatively bulky, unweildy prior art front loading mechanism, as compared to that which may be required for picking up small household trash containers in close quarters, such as that of an alley way where the containers are disposed on opposite sides of the alley way adjacent to fences or the like and in random locations.

SUMMARY OF THE INVENTION

The present invention relates to a container handling mechanism for trash collecting vehicles and particularly, to a handling mechanism which is related to a very compact, highly maneuverable trash collecting vehicle adapted for use in mechanically handling and emptying household trash containers which may be positioned in confined areas, such as narrow alley ways and in various locations in the alley ways, such as random positions at opposite sides of an alley way; the mechanism of the invention being particularly compact and adapted for use in connection with a very compact vehicle so as to provide for rapid handling of such small containers and maneuverability of the vehicle such that the containers may be grasped and handled very quickly and very efficiently in restricted areas and in a great variety of positions and locations, especially where there are groups of such containers as may be found in municipal alley ways behind dwellings. The invention comprises novel container handling mechanism which includes container grasping and pickup means moveably mounted at the forward portion of a very compact vehicle having an articulated steering mechanism, which includes vertical pivotal axis about which forward and rearward portions of the vehicle are pivotally connected and wherein a trash receiver is open over the vertical axis about which the front and rear portions of the vehicle are steerably connected so that the handling mechanism directed to the vertical axis will always be over the open portion of the trash receiver, even though the vehicle may be turned in various directions during its maneuvering and picking up of trash containers at opposite sides of alley ways or in various other random positions. The mechanism of the invention comprises a container grasping and handling means mounted on the forward front portion of the vehicle adjacent to driver control mechanism so that the grasping mechanism may be in full view of the operator as it is actuated and mechanically grasps household trash containers preliminary to moving them upward, backward and into an upsidedown position over an open receiver on the rearward portion of the vehicle.

The mechanism comprises arm means pivotally mounted on a pivotal support mechanism, and the pivotal mounting of the arm on said mechanism is disposed generally on a horizontal axis and means is provided for moving the pivotal support upward and downward on a track which is generally inclined upwardly and rearwardly toward the rearward portion of the vehicle. The arm carried by the pivotal support is actuated about the horizontal axis by means of sprocket and chain mechanism which concurrently rotates the arm about said horizontal axis and a hydraulic cylinder moves said pivotal support upwardly or downwardly on the track means. Accordingly, the mechanism is particularly adapted to a compact short wheel base trash collecting vehicle having articulated steering which includes a vertical axis about which the forward and rearward portions of the vehicle are pivotally connected together; the pivotal mounting of the pivkup arm on a horizontal axis, which is elevatable upwardly and moveable downwardly provides for rapid operation and compact and short wheel base features of the vehicle on which the collecting means of the invention is mounted; the track means of the mechanism, being inclined upwardly and backwardly, provides for guidance of the elevation of the arm means of the mechanism, while also moving the pivotal axis backwardly so as to afford a rearward movement of the arm as it carries a household trash collecting container upwardly and backwardly to an upsidedown position over an open portion of a trash receiver on the rearward portion of the vehicle, thus providing very compact overall mechanism combined with the compact features of the vehicle chasis which is very articulate and highly maneuverable. The container handling mechanism is so arranged that it always moves a household trash collecting container into an upsidedown position substantially over and aligned with the vertical axis of articulated steering of the chasis of the vehicle, which axis is aligned with a pivotal connection of the front and rear portions of the vehicle which are supported by front and rear wheels. Thus, the trash collecting container is always emptied over an open portion of a trash receiver regardless of the direction in which the forward portion of the vehicle is steerably disposed relative to the rearward portion of the vehicle.

The invention also comprises a novel container handling and actuating mechanism wherein a container handling arm is pivoted on a horizontal axis which is moved upwardly and downwardly on track means by power mechanism, such as a hydraulic cylinder, and connected to the arm is an arcuate means about which a cable is wrapped and secured; the cable being anchored to the frame of the machine such that the cable wraps around the arcuate means progressively as the hydraulic cylinder forces the horizontal axis means of the arm upwardly and downwardly throughout the full travel of its stroke from a lowermost position to an uppermost position, thereby providing positive and continuous pivotal movement of the arm about its horizontal axis during the movement of the pivotal axis of the arm upwardly and downward on guide means such that the arm may be moved from a lowermost generally horizontal pickup position to an upper position in which the grasping mechanism holding a trash container is disposed in a generally upsidedown dumping position. Accordingly, the cable mechanism is constantly engaged with the arcuate mechanism so that constant and continuous rotation of the arm about its horizontal axis will occur during the stroke of the hydraulic cylinder from its lowermost position to its uppermost position as it moves the horizontal axis or pivot of the arm upwardly and downwardly, and thereby avoiding high acceleration of the pivotal movement of the arm as it reaches an uppermost position.

Thus, the cable mechanism of the invention, as well as the chain and sprocket mechanism hereinbefore described, distinguishes from the prior art in that the continuous rotary movement alleviates high stress conditions in the tipping of the container from a horizontal position to a generally upsidedown dumping position.

Accordingly, it is an object of the present invention to provide a novel container handling mechanism for trash collecting vehicles, and particularly adapted for mechanically handling small household trash containers in restricted areas, such as alley ways or the like.

Another object of the invention is to provide a container handling mechanism for trash collecting vehicles having novel means for pivoting a container handling arm mechanism about a horizontal axis and concurrently elevating the pivotal axis so as to provide for very compact mechanism useable in connection with a very compact and highly maneuverable vehicle.

Another object of the invention is to provide a novel container handling mechanism for trash collecting vehicles which functions in combination with a compact trash collecting vehicle having articulated steering in which the forward and rearward portions of the vehicle are pivoted together about a substantially vertical axis and wherein a container handling mechanism moves a small household container from a horizontal position in the front of the vehicle upwardly, backwardly and into an upsidedown position substantially over the aforementioned vertical axis so that the trash container will be emptied into a receiver on the rearward portion of the vehicle, which overlies the pivotal axis aforementioned, and such that the household trash collecting container will always be emptied over the open receiving portion of the trash receiver on the rearward portion of the vehicle regardless of the steering disposition of the front portion of the vehicle relative to the rearward portion thereof.

Another object of the invention is to provide container handling mechanism which is provided with very simple cable means wrapped around arcuate structure concentric with a horizontal pivotal axis of the container pickup arm of the invention and such that the horizontal axis means is moved upward and downward by power means, such as a hydraulic cylinder, whereby the movement of the pivotal axis means and the arcuate means causes the cable to wrap and unwrap around the arcuate means and to thereby rotate the container pickup arm of the invention about the horizontal axis means continuously as the upward and downward movement of the horizontal axis means is accomplished by actuation of the hydraulic cylinder.

Another object of the invention is to provide a container handling mechanism particularly adapted for handling small household trash collecting containers very rapidly and efficiently.

Further objects and advantages of the invention may be apparent from the following specification, appended claims and accompanying drawings.

DESCRIPTION OF THE PREFERRED EMBODIMENTS

Figure 1:
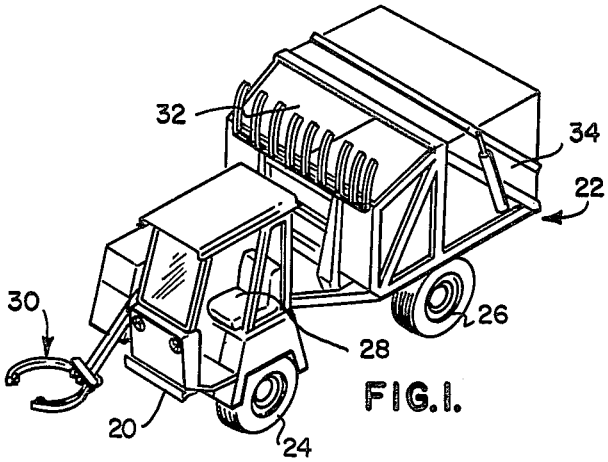
FIG. 1 is a perspective view of a trash collecting vehicle having a container handling mechanism in accordance with the present invention.
Figure 2:
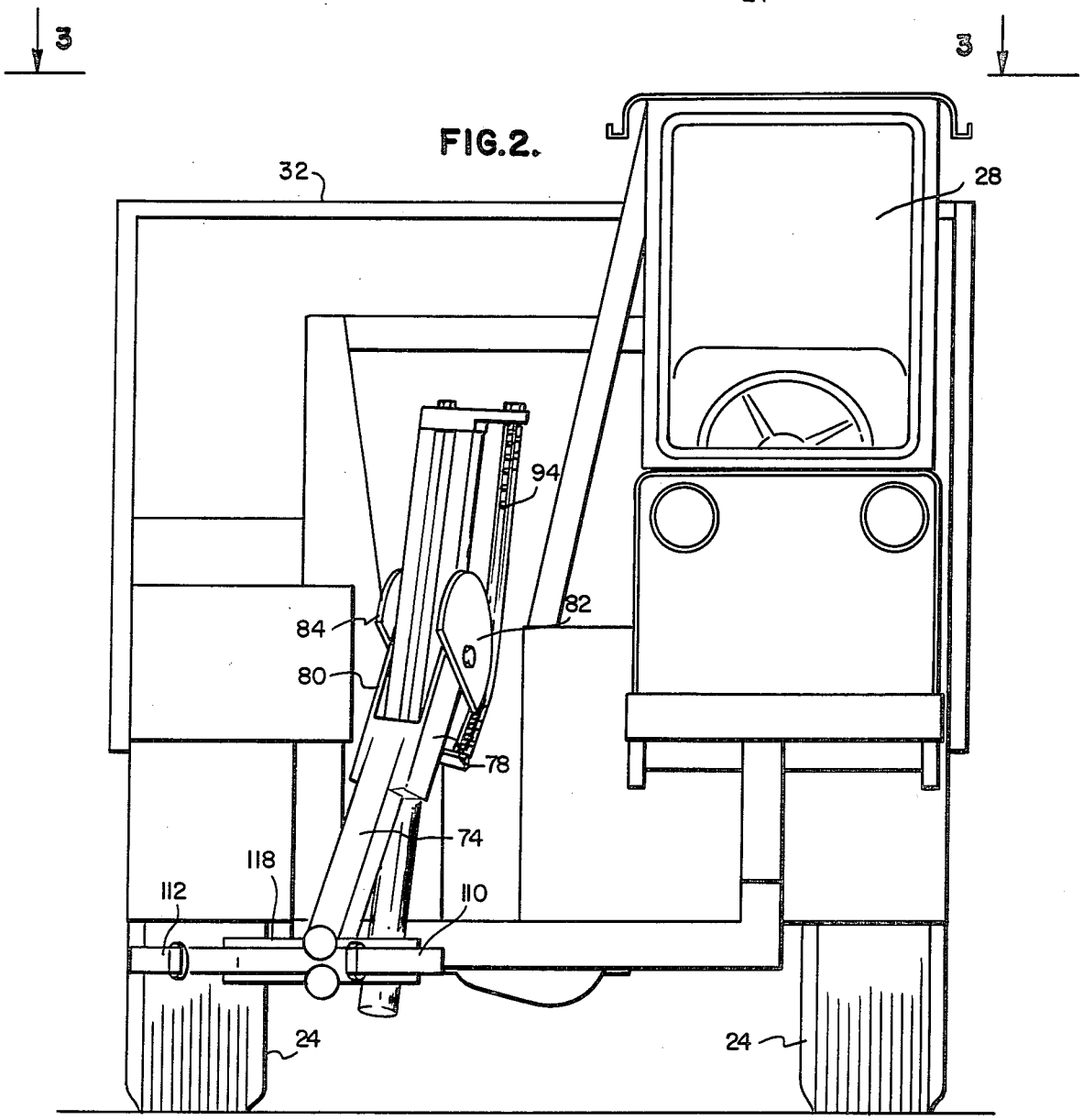
FIG. 2 is a front end view of the vehicle shown in FIG. 1 and also showing in more detail and container handling mechanism of the invention.
Figure 3:
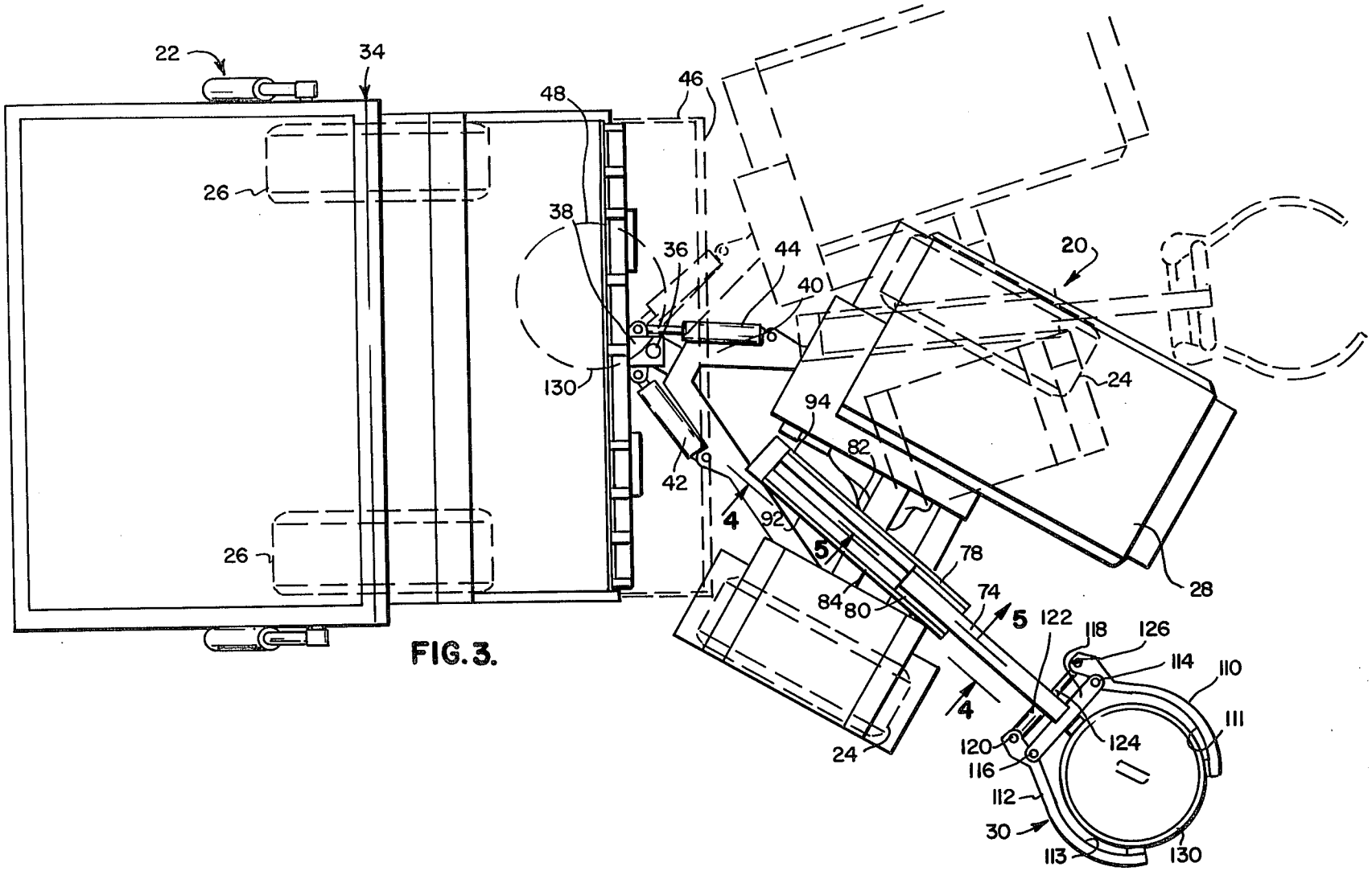
FIG. 3 is a top or plan view taken from the line 3—3 of FIG. 2.

As shown in FIGS. 1, 2 and 3 of the drawings, the trash collecting vehicle carrying the container handling mechanism of the invention is provided with a forward end 20 and a rearward end 22 supported on wheels 24 and 26 respectively. The vehicle is provided with a driver's compartment 28 and a container grasping and pickup means 30 on the forward portion 20 of the vehicle. The container grasping and pickup means 30 is in close proximity to the driver's or operator's compartment 28 so that it can be viewed directly as the container grasper is positioned about a conventional household trash container by maneuvering the vehicle into such position. The container handling mechanism includes the grasper 30 and is particularly adapted for picking up conventional household trash containers at a ground level and lifting them upward and backward for depositing the trash from the container into an open portion 32 of a trash receiver 34 carried on the rearward portion 22 of the vehicle shown in the drawings.

As shown in FIG. 3 of the drawings, the forward and rearward portions 20 and 22 of the vehicle are pivoted together about the vertical axis of a pivot pin 36 to provide articulated steering between the front wheels 24 and the rear wheels 26. The pivot pin extends vertically through a forward portion 38 of a rearward frame, which is coupled to the rear wheels 26 and the pivot pin 36 also extends through a rearward portion 40 of the frame, which is coupled to the front wheels 24; and a pair of hydraulic cylinders 42 and 44 serve to pivot the forward portion 20 of the vehicle relative to the rearward portion 22 about the normally vertical axis of the pivot pin 36 such as to provide articulated steering of the vehicle.

The trash receiver 34 is provided with said open portion 32 which extends to the broken line positions 46, as shown in FIG. 3, when in open position. This position 46 overlies the vertical axis of the pivot pin 36 so that a container, as indicated by broken lines 48 in FIG. 3 of the drawings, may be elevated and moved rearwardly to an upsidedown position as represented by the broken line 48. This position 48 is above the pivotal axis 36 and generally aligned therewith so that as the vehicle is steerably moved to various angular positions, as indicated by broken lines in FIG. 3, the container handling mechanism of the invention will always place the container in the broken line position, as indicated at 48 in FIG. 3 of the drawings, regardless of the direction in which the articulated steering of the vehicle disposes the forward and rearward portions 20 and 22 of the vehicle.

Figures 4, 5:
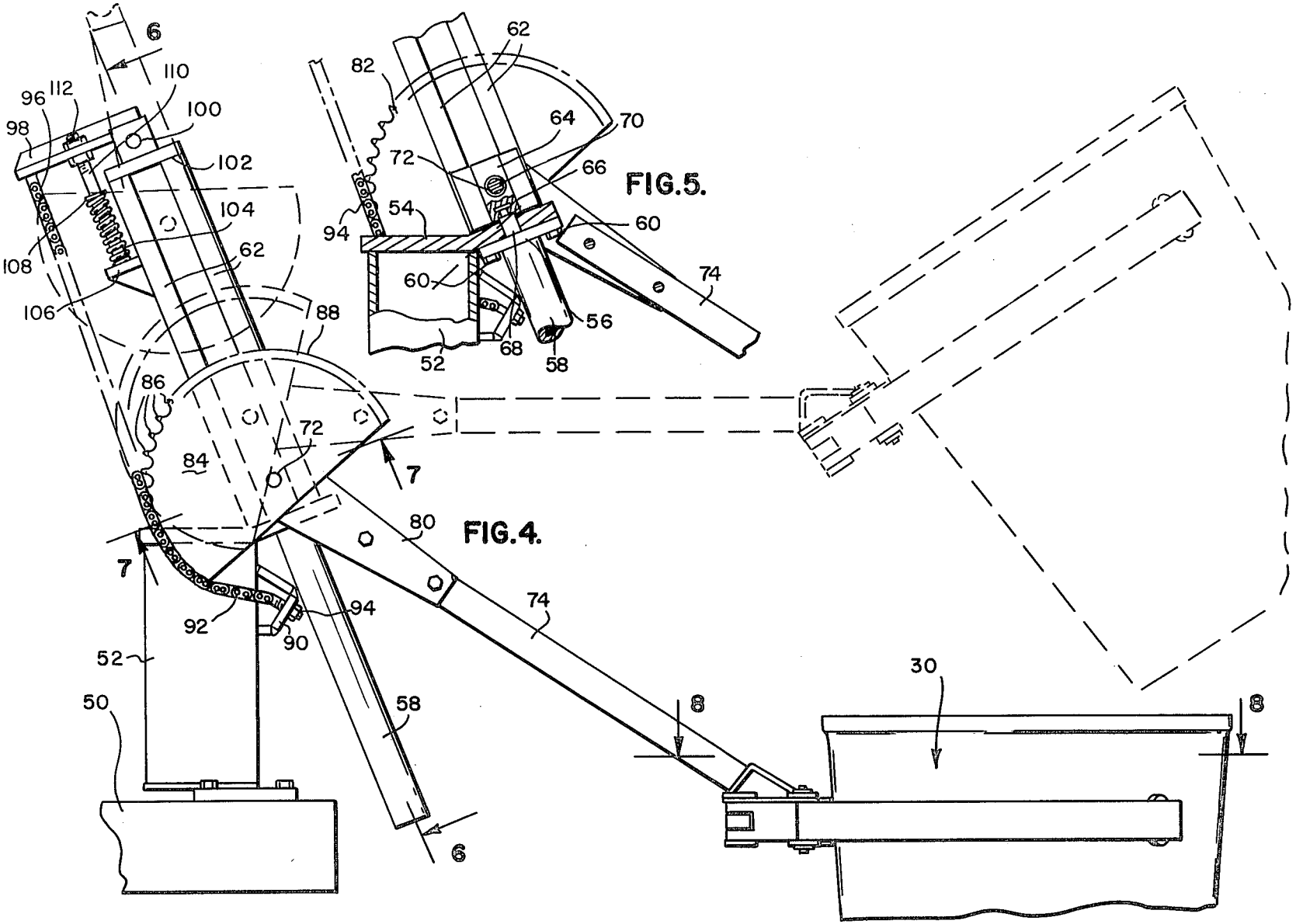
FIG. 4 is an enlarged fragmentary sectional view taken from the line 4—4 of FIG. 3 showing details of the container handling mechanism of the invention.
FIG. 5 is a further fragmentary sectional view taken from the line 5—5 of FIG. 3 showing additional detail of the container handling mechanism of the invention.
Figure 6:
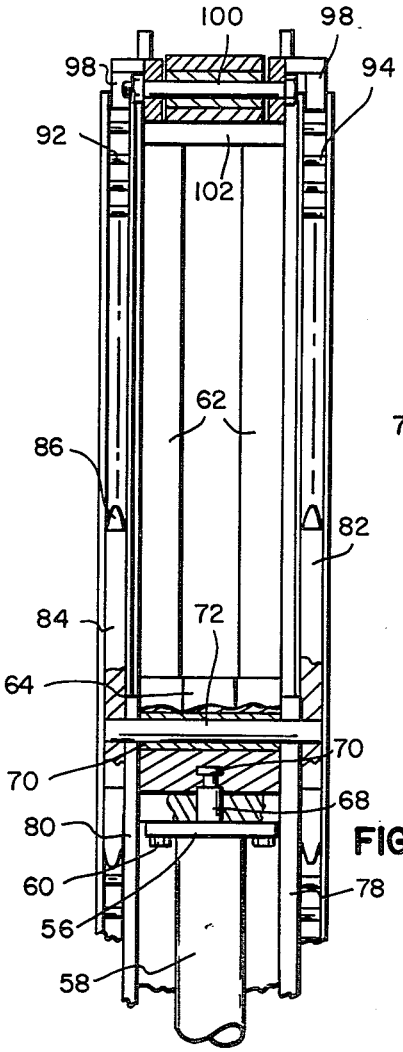
FIG. 6 is a fragmentary sectional view taken from the line 6—6 of FIG. 4.
Figure 7:
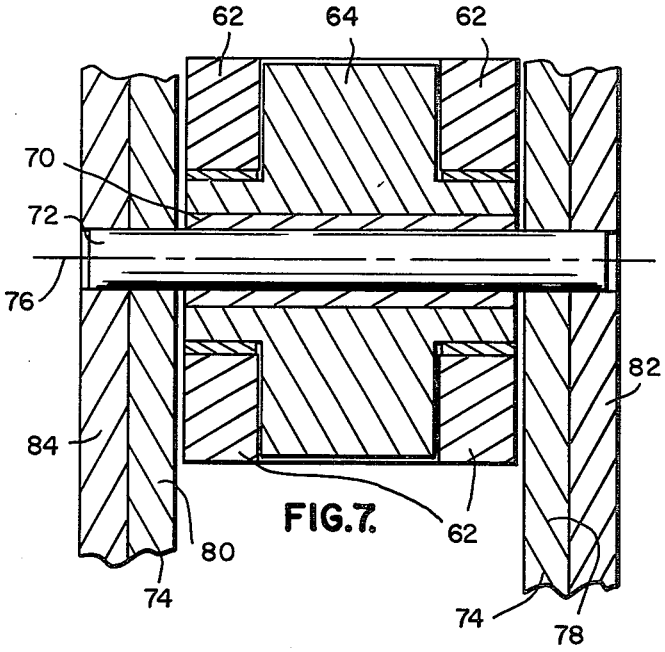
FIG. 7 is a fragmentary sectional view taken from the line 7—7 of FIG. 4.

The container handling mechanism of the invention is shown in detail in FIGS. 3, 2, 4, 5, 6, 7 and 8, and as shown in FIG. 4, a frame portion 50 of the forward portion 20 of the vehicle is provided with an upstanding structure 52 carrying a mounting plate 54 to which a flanged end 56 of a hydraulic cylinder 58 is secured by bolts 60. Also mounted on the plate 54 are four upstanding guide bars 62, shown in cross section in FIG. 7 of the drawings. These guide bars 62 extend upwardly on an incline and rearwardly toward the rearward portion 22 of the vehicle of the invention. Moveable longitudinally of these elongated guide bars 62 is a pivotal mounting means 64. This pivotal mounting means 64 is secured to an end 66 of a plunger 68 of a hydraulic cylinder 58 and extending laterally through the pivotal mounting member 64 is a bushing 70 through which a pin 72 extends; this pin 72 acting as a pivotal axis means for an arm 74 of the container handling mechanism of the invention. The axis 76 of the pin 72 is disposed horizontally, as shown best in FIGS. 5 and 7 of the drawings.

Carried by this pin 72 is the container handling mechanism arm 74, which is composed of a pair of arm portions 78 and 80, which straddle the track means 62, and adjacent the arm portions 78 is a sprocket 82 and adjacent the arm portion 80 is a sprocket 84. These sprockets 82 and 84 are similar and therefore the sprocket 84, shown in FIG. 4, will be described in detail. This sprocket 84 is a quadrant of a sprocket and is provided with sprocket teeth 86 on an arcuate portion 88 thereof. The arm portion 80 is fixed to the sprocket quadrant 84, while the arm portion 78 is fixed to the sprocket quadrant 82.

Mounted by means of a bracket 90 on the upstanding frame portion 52, is a roller chain 92. This roller chain 92 is anchored at its lower end by means of a bolt 94 extending through the bracket 90. This roller chain 92 is provided with an upper end 96 connected to a spring loaded arm 98, which is pivoted at 100 on an upper end plate 102 fixed to the track members 62. The roller chain 92 is substantially coextensive with the track members 62.

A compression spring 104 carried on a stationary bracket 106 acts against a shoulder 108 on a guide bolt 110 which is fixed by nuts 112 to the pivoted arm 98. The bracket 106 is mounted in stationary position on a pair of the guide bars 62 and the compression spring 104 tends to pivot the arm 98 about the axis of the bolt 100 and to thereby create tension in the roller chain 92 and a similar roller chain 94 which cooperates with the respective sprocket quadrants 84 and 82 respectively.

Figure 9:
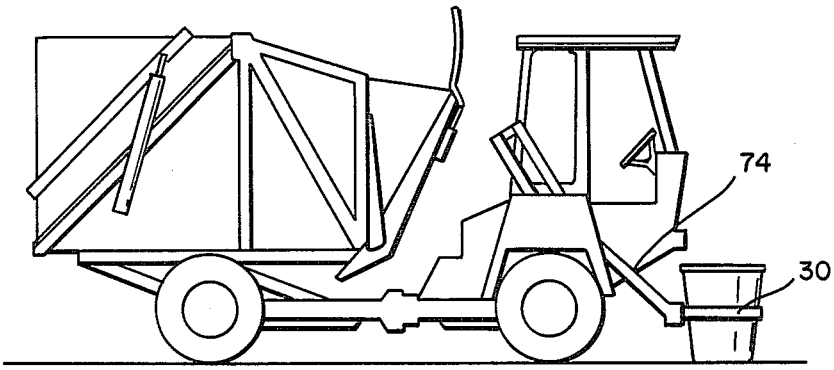
FIG. 9 is a side elevational view of the vehicle and container handling mechanism shown in FIG. 1 and showing the container handling mechanism grasping a conventional household trash container on the ground.
Figure 11:
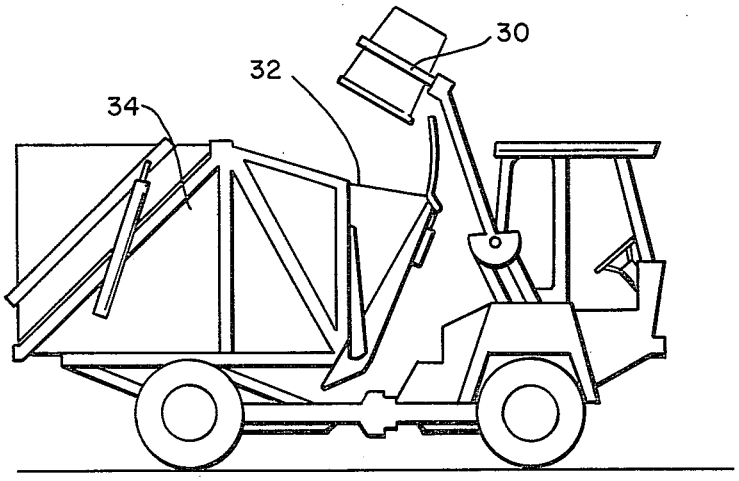
FIG. 11 is a view similar to FIGS. 9 and 10 but showing the container handling mechanism of the invention in an upward rearward and upsidedown position wherein it is emptying a household trash container such that the contents thereof are emptied into a receiver on the rearward portion of the vehicle.

It will be seen that when the plunger 68 of the hydraulic cylinder 58 is extended upwardly, it moves the pivotal mounting means or the block 64 upwardly between the guide track members 62 and causes the sprocket quadrants 82 and 84 to follow the respective roller chains 94 and 92 and to thereby cause rotation of the arm 74 about the axis of the pin 72 which is carried upwardly in the mounting means or block 64, and thus, the arm 74 may swing from a position shown in FIG. 9 adjacent to the ground to the position shown in FIG. 11 which carries the container grasper and respective container upwardly and backwardly into an upsidedown position for emptying the container of its contents and depositing such contents in the open portion 32 of the receiver 34.

The quadrants 82 and 84 are constantly engaged with the respective roller chains 94 and 92 during all movements of the quadrants up and down relative to the corresponding movement of the block 64 between its lowermost position and its uppermost position on the track members 62.

The container grasping mechanism 30 carried by the arm 74 comprises a pair of calliper like container engaging members 110 and 112, which are pivoted on pins 114 and 116 respectively which are carried on a T-shaped head 118 of the arm 74. Pivotally connected to the calliper like member 112 by means of a pin 120 is a hydraulic cylinder 122 which is provided with a plunger 124 pivotally connected by a pin 126 to the calliper like arm 110.

Figure 8:
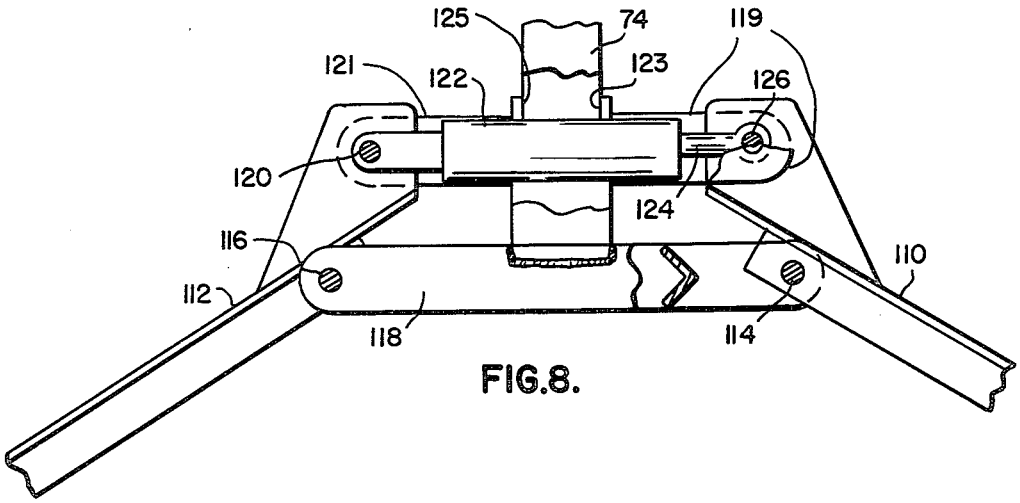
FIG. 8 is an enlarged fragmentary sectional view taken from the line 8—8 of FIG. 4.

As shown in FIG. 8, the calliper like grasper members 110 and 112 are provided with stop members 119 and 121 respectively which bear against opposite sides of the arm 74 at 123 and 125 respectively to establish predetermined open positions of the members 110 and 112.

Retraction of the plunger 124 in the cylinder 122 causes the calliper like arm 110 and 112 to separate into relatively open position, as shown in FIG. 8 of the drawings, and extension of the plunger 124 from the cylinder 122 causes the calliper like arms 110 and 112 to grasp opposite sides of a household trach container 130 shown best in FIG. 3 of the drawings. This container 130 corresponds to the upsidedown broken line position 48 hereinbefore described when the container is being emptied into a trash receiver in a position such as shown in FIG. 11 of the drawings.

Accordingly, it will be appreciated that the hydraulic cylinder 122 is operated by controls in the driver's compartment 28 and also cylinders 42 and 44 are controlled in similar manner while steering and engine controls are also contained in the driver's compartment 28.

Figure 10:
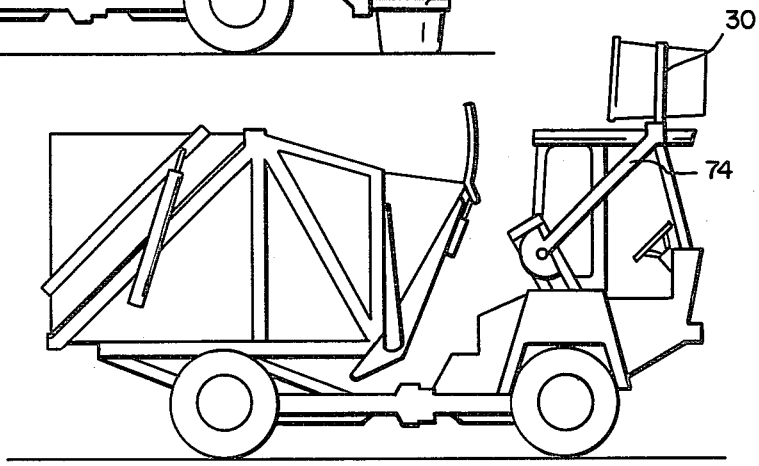
FIG. 10 is a view similar to FIG. 9 but showing the container handling mechanism of the invention moving a household trash container in a direction upwardly and backwardly toward a receiver on the rearward portion of the vehicle.

It will be appreciated that the upwardly and rearwardly inclined relation of the guide member 62 guides the pivotal mounting block 63 in an upward and rearward direction as the plunger 68 of the hydraulic cylinder 58 is extended which carries the pin 62 and the sprocket quadrants 82 and 84, such that traction thereof on the respective chains 92 and 94 causes the arm 74 to rotate progressively from the position shown in FIG. 9 to the position shown in FIG. 10 and finally, to the position shown in FIG. 11, wherein the container is transferred from a normally upright position adjacent the ground, as shown in FIG. 9, to an upsidedown position, as shown in FIG. 11, over the trash receiver open end 32. It will be appreciated by those skilled in the art that the combined movements of the container handling mechanism are important with relation to a short, compact and highly maneuverable vehicle, as as disclosed herein.

The concurrent elevation of the pivotal mounting pin 72 for the arm 74, and the constant rotation of the arm 74 about the axis of the pin 72, and also the incline of the guide 62, provide for a relatively short arm 74 in proportion to the elevation of the trash receiver 34 at its open end or open area 32.

Also, this mechanism with the short arm 74 and the incline track means provide for efficient handling of the container from ground level to a dumping position shown in FIG. 11 in cooperation with the vertical axis of the pin 36, which provides cooperation of the container handling mechanism with the trash receiver open portion 32. It will be seen that the axis of the arm 74 longitudinally substantially aligns with the vertical axis of the pin 36 and therefore insures that the container 130 will be moved to the position 138 over the open portion 32 of the receiver 34, regardless of the direction in which the front end of the vehicle is steered relative to rear end about the vertical axis of the pin 36.

As shown in FIG. 3 of the drawings, the calliper like members 110 and 112 are curved and provided with concave portions engageable with opposite sides of a circular in cross section container 130. However, various container configurations and conforming configurations of the grasper arms 110 and 112 may be utilized.

Figures 12, 13:
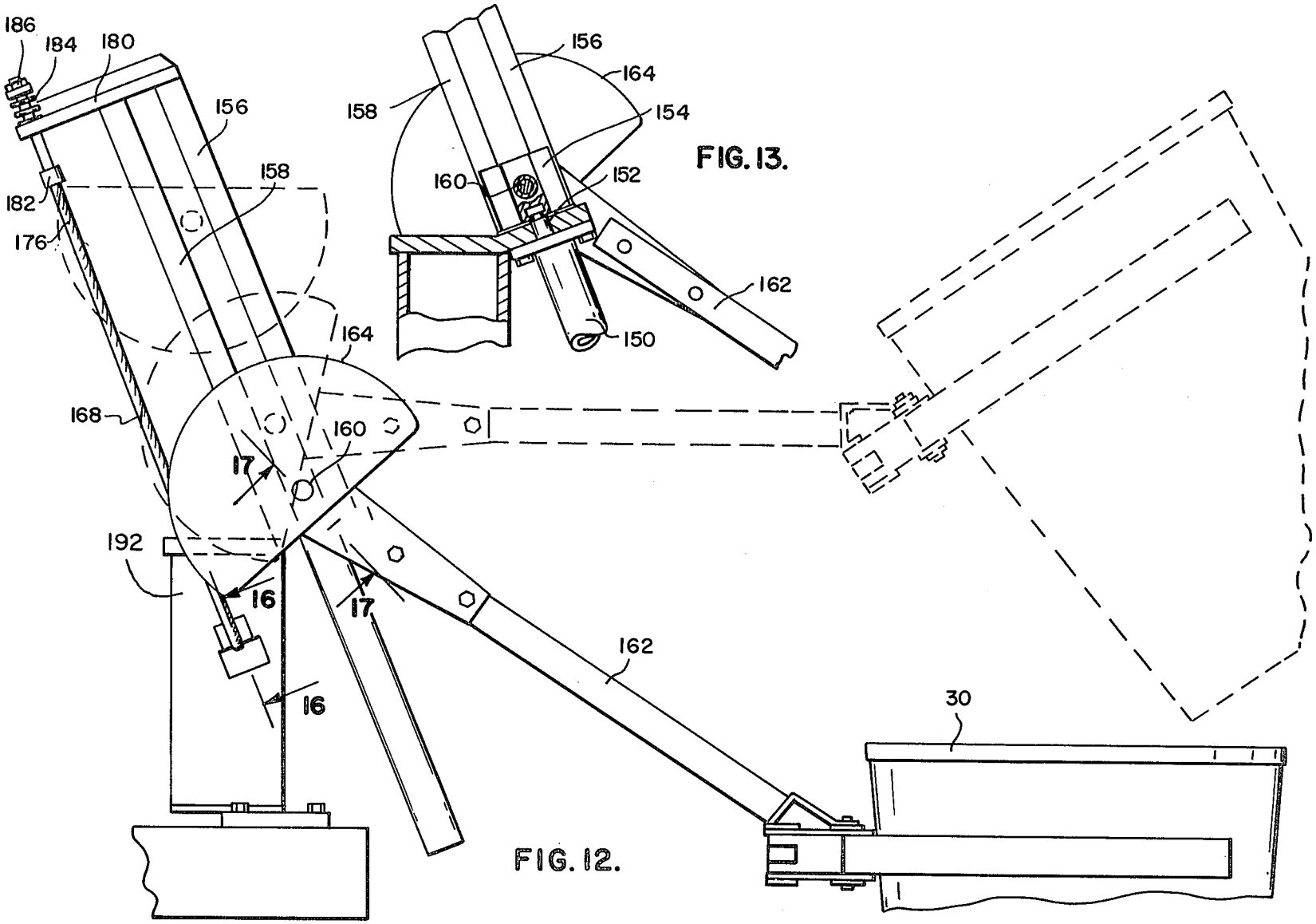
FIG. 12 is a view similar to FIG. 4 but showing a modification of the invention.
FIG. 13 is a view similar to FIG. 5 but showing details of the modification disclosed in FIG. 12.

As shown in FIGS. 12 and 13, the container handling arm actuating mechanism is similar to that shown in FIGS. 4 and 5 except that the quadrants or arcuate means are provided for engagement with cables.

As shown in FIGS. 12 and 13, a hydraulic cylinder 150 is similar to the cyliner 58 and is provided with a plunger 152 connected to a block 154 which travels upward and downward inbetween tracks 156 and 158 which are similar to the tracks 62 shown in FIG. 5.

Carried by the block 154 is a horizontal pivotal axis pin 160 which forms a pivotal axis for the container handling arm 162 which is similar to the arm 74 hereinbefore described in FIG. 4 of the drawings.

Figure 14:
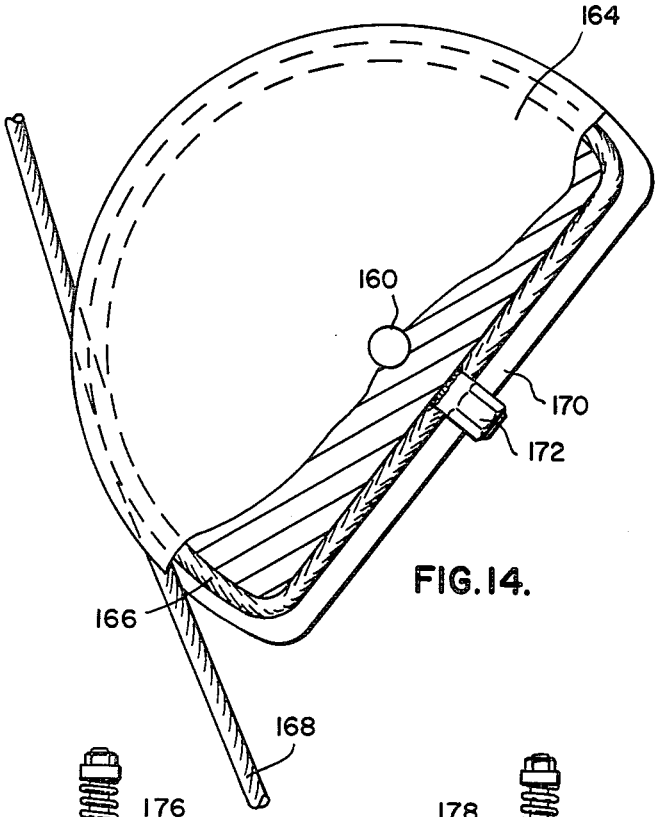
FIG. 14 is a fragmentary view of the arcuate means connected to the container handling arm and showing cable wrapped around the arcuate means and fixed thereto.
Figure 15:
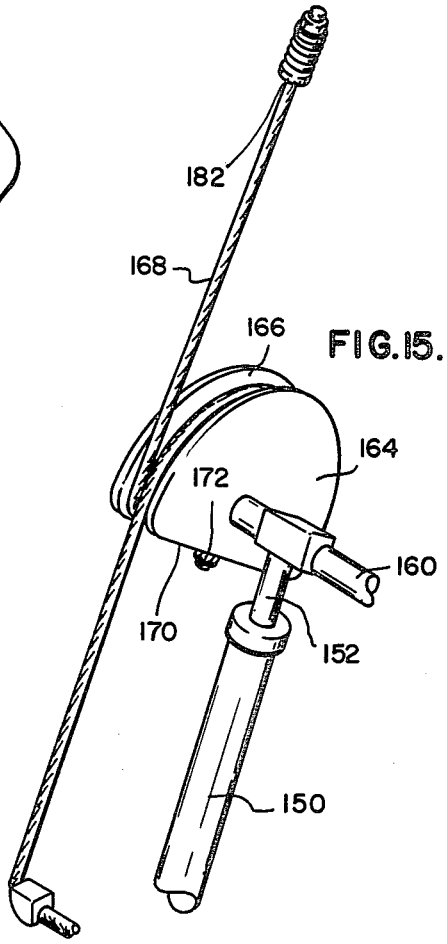
FIG. 15 is a perspective view of the aforementioned arcuate means with the cable wrapped therearound and showing a hydraulic cylinder coupled to the horizontal axis means of the container handling arm for actuating it upward and downward in a track means not shown in FIG. 15.
Figure 17:
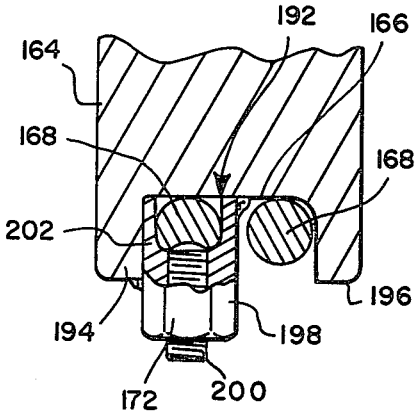
FIG. 17 is an enlarged fragmentary sectional view taken from the line 17—17 of FIG. 12.

Quadrant or arcuate means 164 are fixed to the arm 162 and these quadrants or arcuate means are each provided with a grooved peripheral portion 166 shown best in FIGS. 14, 15 and 17.

A flexible cable 168 is wrapped around each arcuate means and it will be seen that each arcuate means is provided with a flat side 170 in which a fixture 172 secures an intermediate portion of the cable in fixed relation to the arcuate means 164. It will be understood that there are two of these arcuate means 164 similar to the sprockets 82 and 84 shown in FIG. 6 of the drawings, and these arcuate means 164 are mounted on the pivotal axis means 160 in a similar manner to that of the sprockets 82 and 84 on the horizontal axis shaft 72.

The cable 168, at its opposite ends 176 and 178, is connected to a stationary arm 180 of the frame which is secured at upper ends of the track members 156 and 158, all as shown best in FIG. 12 of the drawings.

As shown in FIG. 12, the upper end 176 of the cable 168 is provided with a bolt fixture 182 which extends upwardly through the arm 180 and a compression spring 184 surrounds the bolt like member 182 and is provided with an adjustment nut 186 adapted to set tension of the spring 184 for relieving the cable 168 of any slack and to maintain is snugly wrapped around the arcuate means 164.

The opposite end 178 of the cable 168 is secured to the arm 180 of the frame in the same manner and is provided with a similar adjusting bolt, nut and spring.

Figure 16:
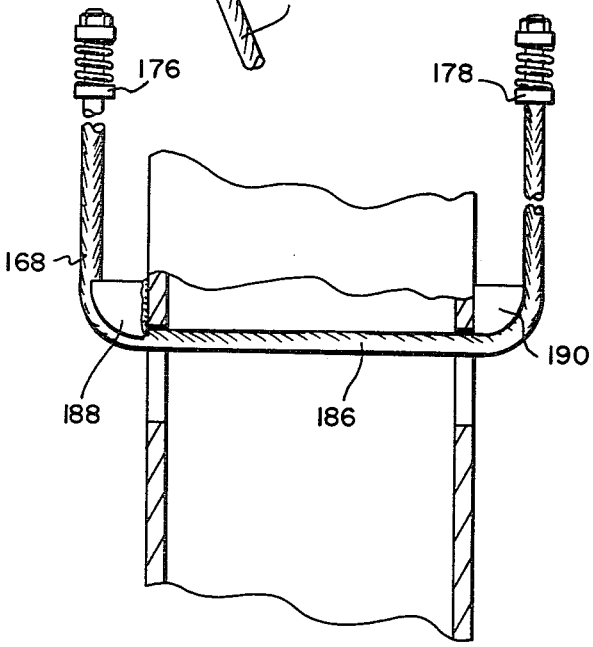
FIG. 16 is an enlarged fragmentary sectional view taken from the line 16—16 of FIG. 12.

As shown in FIG. 16, it will be seen that an intermediate portion of the cable 168 is designated 186 and passes over a pair of arcuate shoes 188 and 190 which are secured in stationary relationship to the frame 192 at a position somewhat below the lower ends of the guide members 156 and 158. The cable, at its intermediate portion 186, is allowed to slide backward and forward slightly relative to the shoes 188 and 190 so as to uniformly adjust the cable snugly to fit the periphery of the arcuate quadrants or structures 164.

It will be seen that the cable 168, as shown in FIG. 17, wraps around the periphery of the arcuate structures 164 within a grooved area 192 between flanges 194 and 194 to thereby assure that the cable does not become displaced from the arcuate members 164.

The fixture 172 hereinbefore referred to is shown in FIG. 17 and it is provided with an internally screwthreaded block 198 in which a set screw 200 is screwthreaded, and the block 198 is fixed to the arcuate means 164 within the groove 192 and an opening 202 is provided in the block 198 such that the cable 168 is extended therethrough and the set screw 200 is tightened to bear on the cable and to fix it in relationship to the arcuate means of quadrant 164.

In operation, the chain and sprocket mechanism shown in FIGS. 4 and 5 of the drawings, and also the cable and quadrant mechanism shown in FIGS. 12 and 13, provide for constant engagement of arcuate means in connection with the container handling arm, either with relation to a roller chain or a sprocket such that a hydraulic cylinder or other means may move the pivotal axis of the container handling arm upward and downward and to cause constant rotary motion of the arm at all positions between the uppermost position and the lowermost position of the pivotal axis means of the container handling arm so that the arm is pivoted from a position in which a container handled thereby is in a generally horizontal position and whereby the container is continuously and gradually pivoted to an upsidedown position as the pivotal axis of the arm reaches its uppermost vertical travel as forced by a conventional hydraulic cylinder or the like. It will be obvious that this mechanism reduces ultimate stress of pivoting the arm from an upright container grasping position to an upsidedown position of the container for dumping it at the uppermost position of travel of the arm.

It will be obvious to those skilled in the art that various modifications may be resorted to without departing from the spirit of the invention.

I claim:

1. In a container handling mechanism for trash collecting vehicles; a frame; a container grasping and pickup means moveably mounted on said frame; actuating means for said grasping and pickup means; said actuating means disposed to move said grasping means upwardly and downwardly; said actuating means provided with pivotal support means adapted to swing said grasping and pickup means about a generally horizontal axis so as to transfer said grasping means from an upright position to an elevated substantially upsidedown position; said container grasping and pickup means comprising a pickup arm; pivotal axis means pivotally mounting said arm on a pivotal support to pivot about said generally horizontal axis; said actuating means disposed for concurrently elevating said pivotal support means and rotating said arm about said generally horizontal axis, of said pivot axis means, to said elevated substantially upsidedown position in which the contents of said container may be emptied into a trash receiver; said actuating means being provided with arcuate means coupled to said arm; and means constantly engaged with said arcuate means and connected to said frame; and means for actuating said pivotal support upwardly and downwardly on said frame to an uppermost position and to a lowermost position whereby constant engagement of said arcuate means with said actuating means causes continuous and concurrent pivotal movement of said arm about said horizontal axis as it moves upwardly and downwardly between said uppermost position and said lowermost position.

2. The container handling mechanism for trash collecting vehicles defined in claim 1, wherein:

rectilinear track means is fixed to said frame and extends in upward and downward directions; said pivotal support means being moveably mounted on said rectilinear track means.

3. The container handling mechanism for trash collecting vehicles of claim 1 in which said actuating means comprises a flexible cable means wrapped around said arcuate means and fixed thereto, opposite ends of said cable being coupled to said frames such that when said pivotal support is moved upwardly and downwardly, said cable wraps and unwraps relative to said arcuate means and forces it to pivot about said horizontal axis and to constantly pivot said arm as the pivotal support is moved upwardly and downwardly.

4. The container handling mechanism for trash collecting vehicles of claim 2 in which roller chains are fixed to said frame at sides of said rectilinear track means, and said pivotal support means comprises arcuate means that has an arcuate peripheral edge formed with teeth engaging said roller chains.

* * * * *